United States Patent [19]

DiMartino, Sr.

[11] Patent Number: 4,599,829

[45] Date of Patent: Jul. 15, 1986

[54] MODULAR CONTAINER BUILDING SYSTEM

[75] Inventor: John M. DiMartino, Sr., Bayport, N.Y.

[73] Assignee: Tandemloc, Inc., Bayport, N.Y.

[21] Appl. No.: 526,473

[22] Filed: Aug. 25, 1983

[51] Int. Cl.[4] ..... E04B 1/35

[52] U.S. Cl. ..... 52/79.7; 52/79.9; 52/106

[58] Field of Search ..... 52/79.1, 79.7, 79.13, 52/79.14, 106, 79.9, 471, 745, 122.1, 125.2, 125.6, 395, 513; 411/340, 341, 342, 343, 344; 403/252, 254; 248/222.1, 357; 294/83 R, 81 SF, 67 DA, 67 R

[56] References Cited

U.S. PATENT DOCUMENTS

| | | | |
|---|---|---|---|
| 1,362,069 | 12/1920 | Witzel | 52/79.13 |
| 2,156,859 | 5/1939 | Lowe | 52/106 |
| 2,905,283 | 9/1959 | Leach | 52/282 |
| 2,916,235 | 12/1959 | Nager | 411/340 |
| 2,963,310 | 12/1960 | Abolins | 294/68.3 |
| 3,284,966 | 11/1966 | Bolt | 52/79.5 |
| 3,312,019 | 4/1967 | Faerber . | |
| 3,372,521 | 3/1968 | Thom | 52/395 |
| 3,423,896 | 1/1969 | Widerby | 52/471 |
| 3,492,767 | 2/1970 | Pincus . | |
| 3,564,786 | 2/1971 | Baker | 52/79.13 |
| 3,722,152 | 3/1973 | Schlatter | 52/79.14 |
| 3,752,511 | 8/1973 | Racy . | |
| 3,792,558 | 2/1975 | Berce | 52/79.7 |
| 3,818,654 | 6/1974 | Schramm | 52/79.3 |
| 3,972,439 | 8/1976 | DiMartino . | |
| 3,992,828 | 11/1976 | Ohe | 52/79.9 |
| 4,006,574 | 2/1977 | Van Der Lely . | |
| 4,120,133 | 10/1978 | Rodgers . | |
| 4,212,251 | 7/1980 | DiMartino . | |
| 4,430,835 | 2/1984 | Ericson | 52/282 |

FOREIGN PATENT DOCUMENTS

| | | | |
|---|---|---|---|
| 2136630 | 2/1973 | Fed. Rep. of Germany | 52/79.1 |
| 2358563 | 5/1974 | Fed. Rep. of Germany | 52/79.7 |
| 2657614 | 7/1977 | Fed. Rep. of Germany | 52/79.1 |
| 1953109 | 8/1978 | Fed. Rep. of Germany | 52/79.1 |
| 572894 | 2/1958 | Italy | 52/79.3 |

OTHER PUBLICATIONS

Civil Engineering vol. 53, No. 7, p. 16.

*Primary Examiner*—John E. Murtagh
*Attorney, Agent, or Firm*—Marvin Feldman

[57] ABSTRACT

A building system is formed of modular shipping container units, with each unit having a specific building environment function, so that when the units are structurally vertically supportably mounted and horizontally connected, a complete building is formed. A specialized designed selectively actuable tightened locking and self-levelling connector interconnects upper and lower container units to take the bearing force of the building. Adjacently mounted corner units are provided with specialized conduits for utilities and drainage. In one preferred embodiment there are inmate cell units and hallway units arranged to form a highly functional prison or correction facility sub-structure.

31 Claims, 15 Drawing Figures

FIG. 2
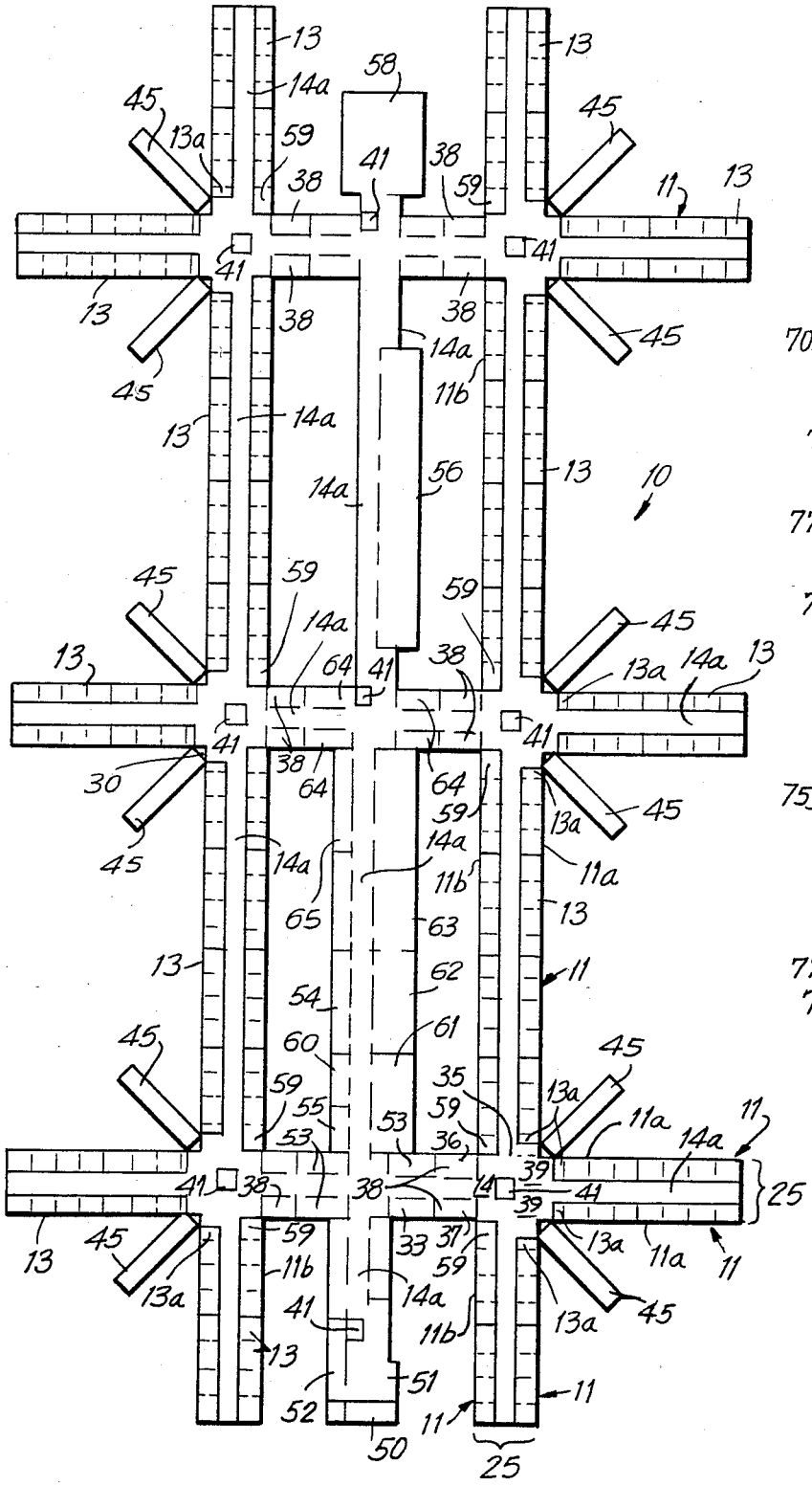
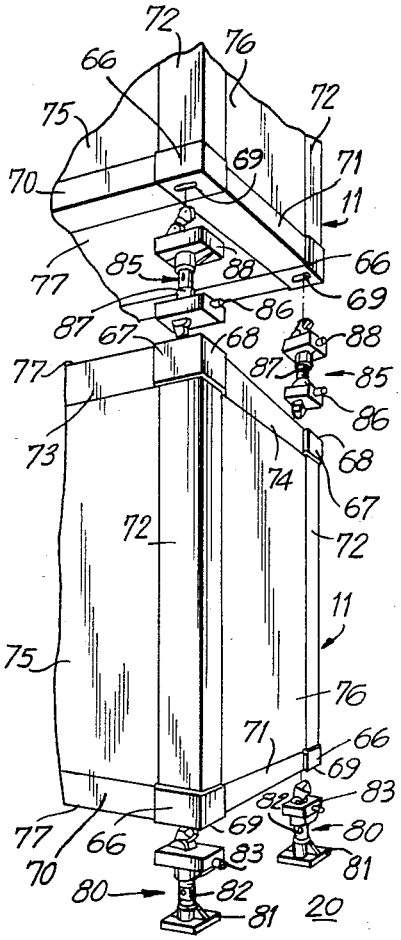
FIG. 3

FIG. 8
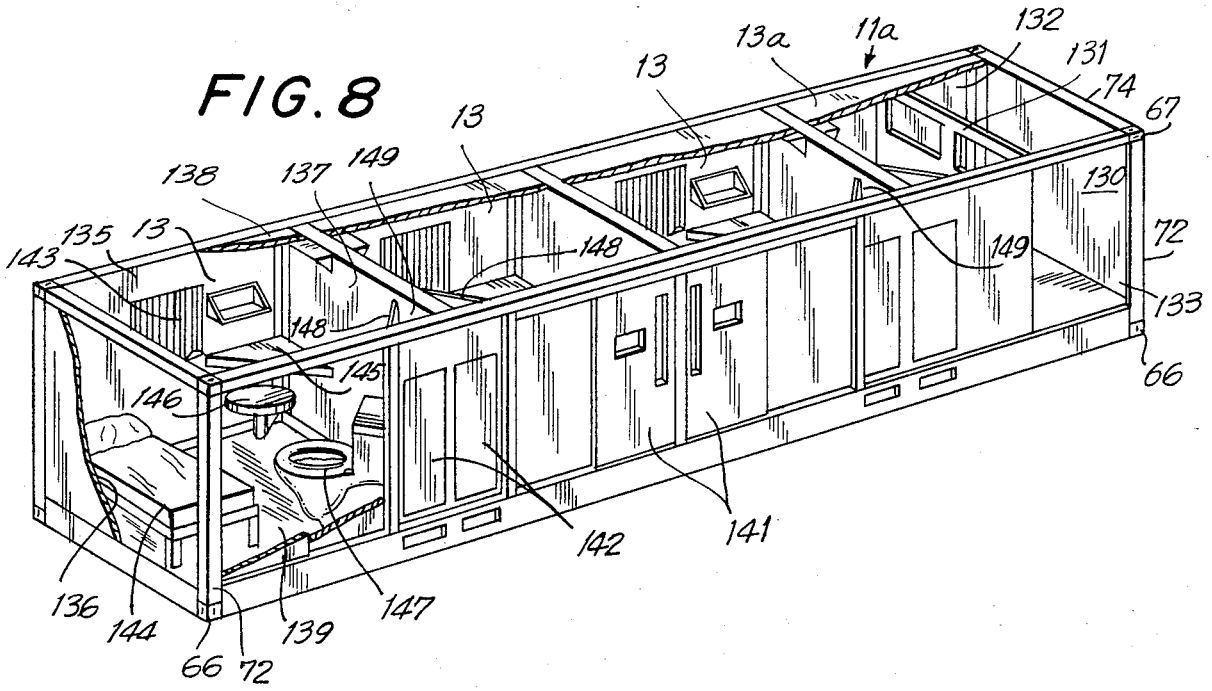
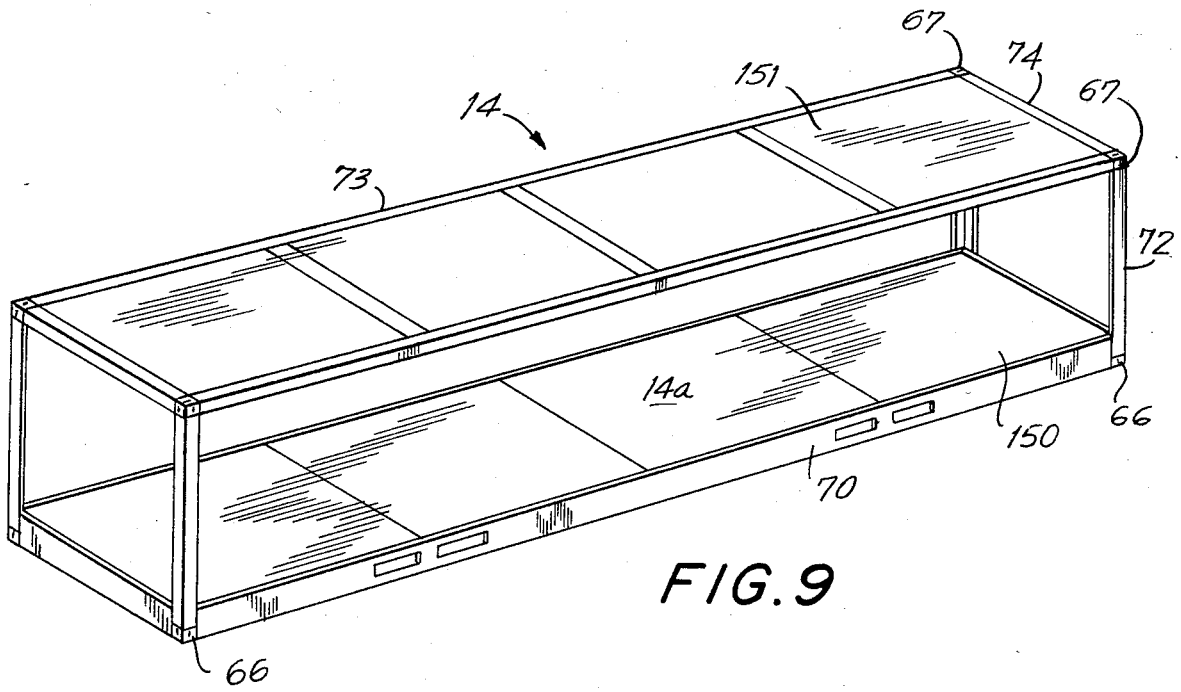
FIG. 9

MODULAR CONTAINER BUILDING SYSTEM

FIELD OF THE INVENTION

This invention relates to construction of a building. Specifically this invention relates to a modular building construction system and the component elements thereof. In one aspect the present invention relates to a modular prison construction.

BACKGROUND AND DISCUSSION OF THE PRIOR ART

Heretofore in the building construction field, it was known to provide a modular unit of multi-functional character, which units could be assembled in multiple numbers, such as disclosed in U.S. Pat. No. 4,120,133, granted Oct. 17, 1978 to Rodger et al., U.S. Pat. No. 3,492,767, granted Feb. 3, 1970 to Pincus, and U.S. Pat. No. 4,006,574, granted Feb. 8, 1977 to van der Lely.

In Rogers et al., it was recognized that the pre-fabricated section of a building could be of the dimension of a shipping container for ease in transport to the building site. Rogers et al., is directed to combining different room element sections to form the multiple sectional pre-fabricated container-sized structure to be transported to the building site.

In a military application there is a Sealift Self Defense Containerization of a Tactical Support System wherein different living environment shipping containers were mounted on and lashed with standard lashing to the deck of a ship. Typically, the system provide for a four helicopter detachment system which included modular units of a maintenance station, a command center, personnel quarters, each of standard shipping container size.

It was also recognized that a specific portable individual cell could be pre-fabricated, transported, and added to an existing prison for expansion, as shown in Faerber, U.S. Pat. No. 3,312,019, granted Apr. 4, 1967, and Schlatter et al., U.S. Pat. No. 3,722,152, granted May 27, 1983.

In the shipping container field, it was known to horizontally interconnect shipping containers by a double connector, so that two undersized units (approx. 20 feet in length) could be connected lengthwise to provide a full sized standard I.S.O. container (approx. 40 feet), as disclosed in U.S. Pat. No. 3,972,439, granted Aug. 3, 1976 to DiMartino. Other connectors include U.S. Pat. No. 4,212,251, granted July 15, 1980 to DiMartino, U.S. Pat. No. 3,973,439, granted Aug. 10, 1976 to DiMartino and U.S. Pat. No. 3,752,511, granted Aug. 14, 1973 to Racy. While these connectors would connect the containers, the connectors did not provide vertical self-tightening and self-levelling as would be necessarily suitable for multiple-storey container building construction.

While the aforesaid prior art represented attempts to provide modular construction with modules of trailer borne shipping container sized units, the prior art was nevertheless directed to modules which contained multi-functional intergrated living environment characteristics, similar in certain respects to a home trailer. It was also the direction of the prior art to take up the bearing stresses of the building structure with both horizontal and vertical structual support members. Standard lashing was also often provided to tighten and hold the shipping container units.

Now, however, there is provided by the present invention, a novel modular multi-storey construction in which there is a plurality of modules, with each module or sets of modules having a distinct specific individual living environment function, and which modules can be assembled in diverse manner to form a complete multi-storey building, and wherein substantially the entire building stress is taken up by the vertical structural members, with self-tightening, self-levelling vertical locking connectors to effectively provide the multi-storey building.

It is therefore a principal object of the present invention to provide a novel building construction system.

It is another principal object of the present invention to provide a novel prison construction system and configuration.

It is a further object of the present invention to provide novel vertical locking, self-tightening and self-levelling connectors for providing structurally sound vertical support of the aforesaid building.

It is another object of the present invention to provide a building system as aforesaid in which expansion in both size and function is readily achievable.

It is another object of the present invention to provide novel utilities conduit construction integrally formed with the building system configuration.

It is still another object of the present invention to provide a novel gutter/drainage system for the building system.

It is still another object of the present invention to provide a building system as aforesaid with novel horizontal connecting members.

It is still a further object of the present invention to provide a building system as aforesaid which is of practical design, and which is readily constructed using relatively inexpensive shipping container elements and other readily manufactured components, and yet is safe and practical in use for the intended purpose of the specific building.

The aforesaid, as well as other objects and advantages as will become apparent from a reading of the following description, the adjoined claims, and the drawings.

BRIEF DESCRIPTION OF THE DRAWINGS

FIG. 2 is a floor plan view of the ground floor of the correction facility of FIG. 1;

FIG. 3 is an exploded perspective view of the mounting connector assembly of one end of the ground level modular container unit of the present invention;

FIG. 8 is a perspective partial fragmentary view of the jail cell berthing container unit of the correction facility;

FIG. 9 is a perspective view of the hallway unit of the correction facility;

BRIEF SUMMARY OF THE INVENTION

This invention is a building system wherein pluralities of specific living environmentally functional modules are assembled in diverse manner to form various building designs, each design being highly useful for its intended purpose. The building may be readily expanded in vertical and horizontal size, as well as in function. Building construction is novel in providing structurally supporting, self-tightening vertical connectors for upper and lower inter-connected container units. The connectors are selectively self-levelling to evenly take up the bearing stress on the vertical members of the structure and ensure a level multi-storey structure. The building system is configured and provided with highly efficient utility and drainage conduits which are integrally formed with construction of the building system.

In one principal aspect the invention is a novel modular construction prison, particularly a multi-storey correction facility.

DESCRIPTION OF THE PREFERRED EMBODIMENTS

Figure 1:
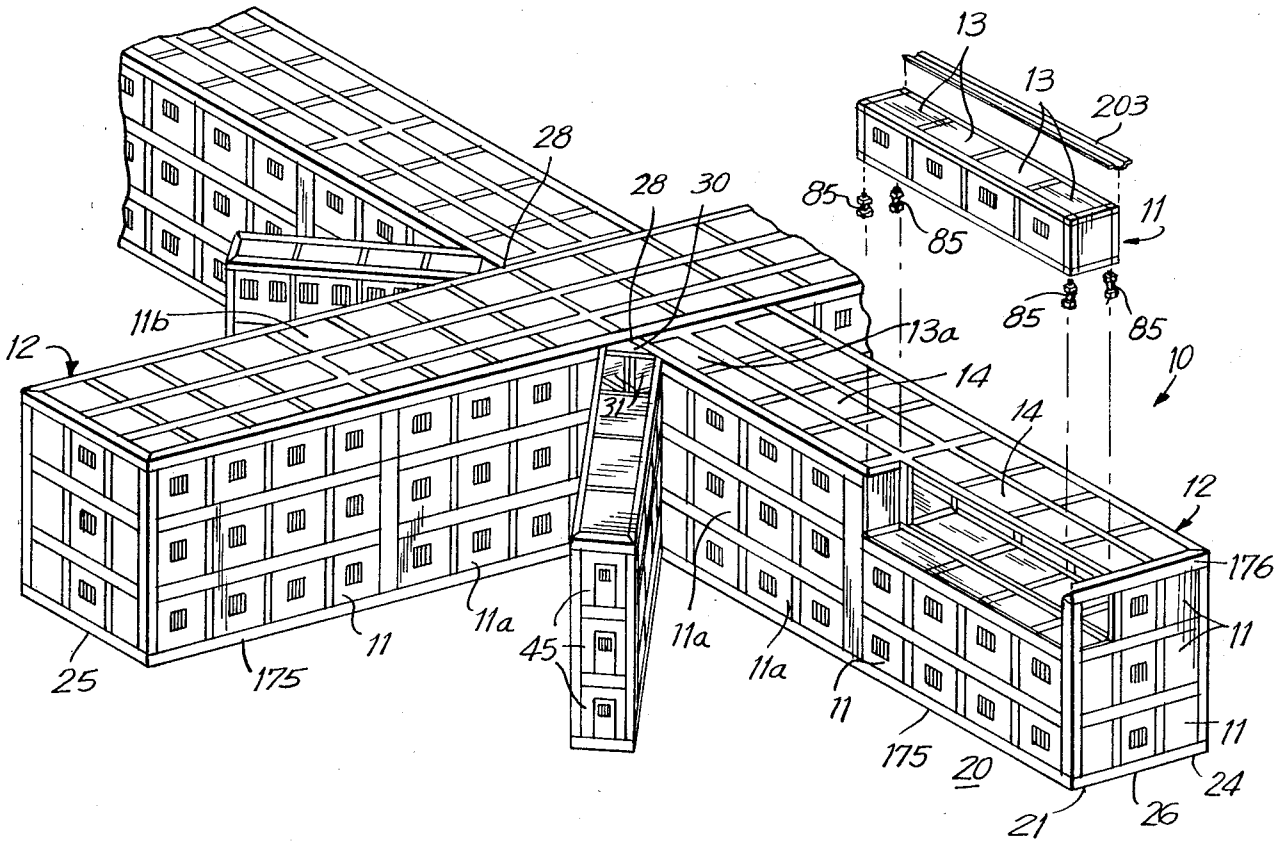
FIG. 1 is a partial exploded and partial fragmentary perspectuve view of a correction facility or prison embodying the present invention.

Referring to FIGS. 1 and 2, there is shown a prison or correctional facility 10 according to the present invention. Correctional facility 10 is formed substantially entirely of modular container units (e.g. unit 11) of similar overall size and connection fittings, such as in standard I.S.O. trailer shipping containers (approx. 40 feet long by 8 feet wide) and standard I.S.O. corner fittings, as will be more fully discussed hereinafter.

A facility sub-section 12 as shown in FIG. 1, is replicated in several areas of facility 10, and it is understood that such replication provides ready size accommodation and expansion of the facility. Container unit 11 is in fact a berthing unit, or more specifically a container unit having four adjacent cells 13 (typical). There are two other variations of unit 11, namely, unit 11*a* which comprises three inmate cells 13 and a shower unit 13*a* (FIG. 8), and unit 11*b* which contains three inmate cells 13, and an observation cell 59 being of higher security construction than the inmate cells 13. Usually cell 59 wil be entirely barred or like high security, high visibility construction. Container unit 14 is a hallway or space expansion unit, as best shown in FIG. 9, as will be described in further detailed hereinafter.

It is to be noted that similar container units are vertically stacked in common. Thus, in viewing corner 16 of sub-section 12, there is shown first plurality 21 of units 11 stacked in three tiers or storeys 17, 18, and 19, from ground level or base 20. A first plurality 26 of hallway units 14 are commonly vertically stacked and mounted in a side-by-side relation to plurality 21, as well as to a second stacked plurality 24 of units 11. In this manner of construction, namely, a hallway unit 14 sandwiched between inmate cell units 11, there is formed a basic modular storey sub-structure 25 for the prison constructed according to the present invention, which sub-structure 25 is replicated throughout facility 10. The three storeys of sub-structures 25 form sub-section 12.

It is noted in FIGS. 1 and 2, that like adjacent sub-sections 12, 12*a* are mounted at right angles to form a corner 28 (typical). A stacked connected plurality 29 of units 45 are mounted between and at 45° to the respective sets of sub-sections at corner 28. A vertically stacked series of triangular corner hallway frames 30 interconnect units 45 of plurality 29 to the units 11 of angled sub-sections 12. Elements 30 are, in fact, upstanding trapezoidal frame members with open walkway areas 31 which communicate with the open area 32 of adjacent shower portion 13*a* (see exposed view portion FIG. 1 and FIG. 8). Units 45 as arranged in plurality 29 are facilitated to serve as the day room or recreation rooms for the inmate cells 13 of the immediately adjacent sub-sections 12, 12*a*. Note that only the top and bottom faces of trapezoidal frame element 30 are closed to serve respectively as the ceiling and floor of element 30.

Referring now specifically to FIG. 2, there is shown sub-section 40 (shaded area) formed of three tiers or storeys of containers 36, 14, and 37 mounted in three side-by-side relationship. Units 36 and 37 are combination stairwell 38 and space extension 39 units, whereas unit 14 is the hallway unit. Units 36, 14, and 37 when horizontally interconnected form a central sub-section 40. Sub-section 40 is provided with four-sided, protective glass-enclosed guard control booth 41, which is positioned so that a guard in booth 41 can simultaneously view the hallways or corridors 14*a* of three inmate cell units intersecting at 90° to each other, as well as the corridor 14 of stairwell egress units 36 and 37, and, as well as into the day rooms 45 disposed at 45° as previously discussed.

In viewing the floor plan of FIG. 2, there is shown a large plurality of different environmental areas each being formed from combinations of shipping container structures, particularly the corridor/space expansion units 14, (with and without one or more side and/or end walls) which when assembled in adjacent horizontal pluralities form large room environmental spaces. The following is a listing of the environmental spaces which form a typical ground floor of correctional facility 10, with the area based on each unit (e.g. 11, 11*a*, 11*b*, 14, 36, 37) being of standard I.S.O. trailer container size (approx. 40 feet long by 8 feet wide).

| No. | Identification | Area (sq. ft) |
|---|---|---|
| 51 | Main Entrance, Identification | 800 |
| 51 | Waiting Area | Included in Above |
| 52 | Prisoner Processing | 320 |
| 41 | Guard, Control Booth | — |
| 14a | Corridor | — |
| 53 | Visitation Room | 1072 |
| 54 | Library | 320 |
| 55 | Attorney/Client Meeting Room | — |
| 56 | Mess Area | 960 |
| 57 | Chapel | 320 |
| 58 | Gym | 1280 |
| 59 | Observation Cell | — |
| 12 | Shower | — |
| 13 | Single Living Cell | 75 |
| 45 | Day Room | 330 |

-continued

| No. | Identification | Area (sq. ft) |
|---|---|---|
| 60 | Dental Facility | 160 |
| 61 | Medical Facility | 640 |
| 62 | Classrooms | 640 |
| 63 | Vocational Training | 1280 |
| 64 | Personal Property Storage | 512 |
| 65 | Maintenance Equipment Storage | 320 |
| 38 | Stairwell | — |

In the aforesaid manner of construction, it can readily be discerned that there is a high replication of modular units to form an entire facility at one level, which level can be replicated into a multiple storey structure. It is an important aspect of the present invention to note that the high security areas having inmate cells 11, 11*a* and 11*b* are disposed around the periphery of the facility whereas the less controlled areas (e.g. 60–65) are disposed on the interior or the structure, and the centralized guard control booths are disposed between the high security areas and the less secured areas, with viewing of both areas simultaneously.

Figure 10:
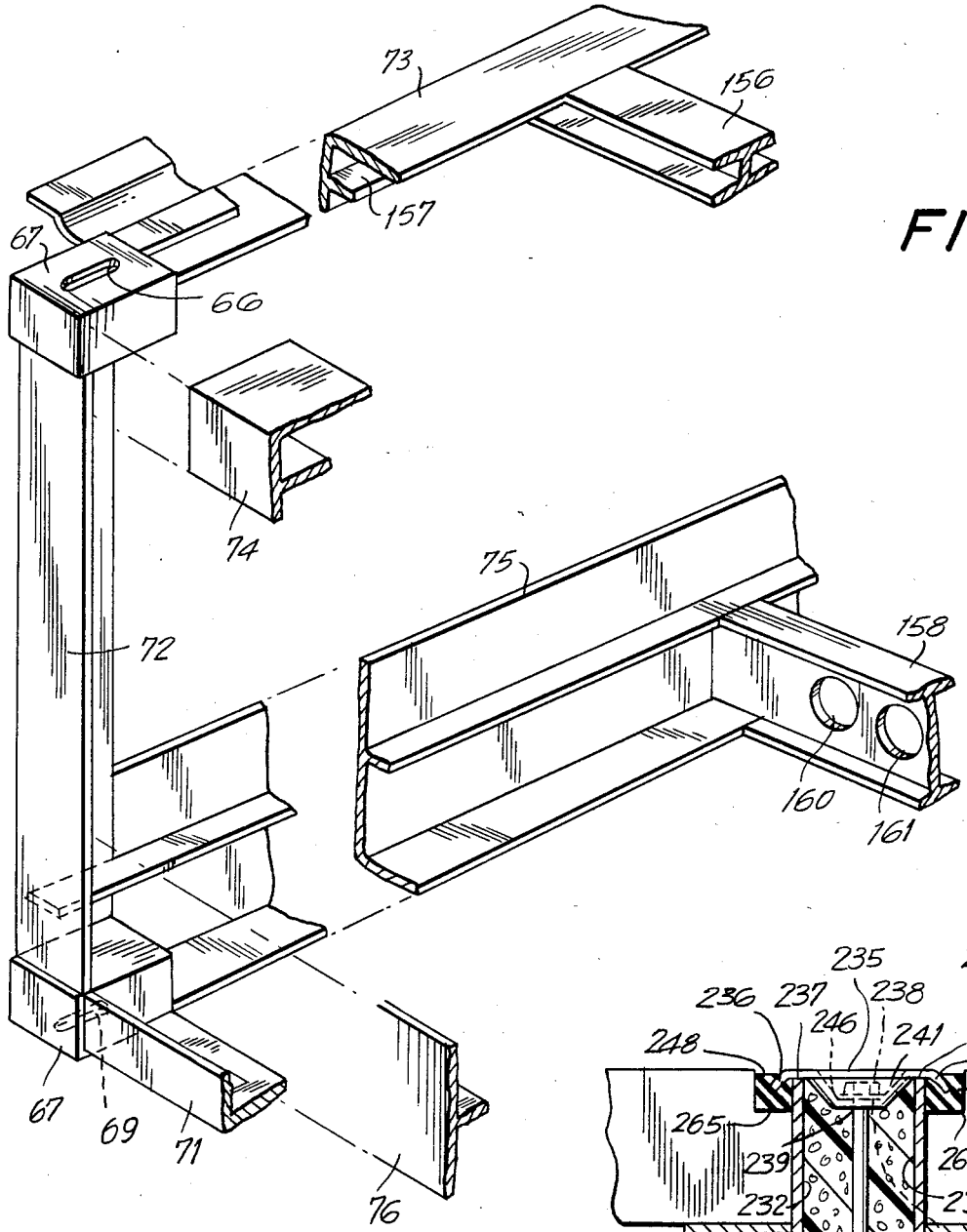
FIG. 10 is a detail view of the corner construction of the container unit.

Another important aspect of the present invention is the vertical assembly or mounting of the container units, as generally shown in FIG. 3, wherein two units 11 are shown in an exploded view of their vertical assembly. Each unit 11, as well as any other building container unit is formed with four bottom corner fittings 66 and four top corner fittings 67. Fittings 66 and 67 are standard I.S.O. freight container corner casting fittings. Typically the I.S.O. corner fittings are formed with side, and bottom or top oval orifices. Fittings 66, 67 are integrally welded to lower side channel frame members 70, lower end angle frame member 71, vertical corner angle frame member 72, upper side channel frame member 73 and upper end angle frame member 74 to form the integral unit 11 (FIG. 10). In a general way sidings 75 and 76, and flooring/roofing 77 may complete the exterior of the unit 11.

Base pad self-levelling connectors 80 are implaced or levelled concrete support pad 20 raised footings (not shown) at spacings equivalent to the four bottom corners of the ground floor unit 11. Connectors 80 in general are each integrally formed of a base pad assembly 81, a self-levelling assembly 82 and a locking assembly 83. The ground floor unit 11 is lifted through the upper I.S.O. fittings 68 in the conventional container handling manner and lowered onto connectors 80, locked into place through orifices 69 by assemblies 83, and levelled through assemblies 82 so that each ground floor unit is both level with the horizontal and at about the same elevation from the ground 20. With the ground floor unit 11 in place, tandem self-levelling connectors 85 are mounted and lock tightened through orifices 68 to the top corners of the ground floor unit 11. Connectors 85 are integrally formed with a lower locking assembly 86, a self-levelling assembly 87, and an upper locking assembly 88. Assemblies 86 and 88 are similar, but oppositely disposed, and are separately actuable. With connectors 85 locked onto ground floor unit 11, second storey unit 11 is lifted and lowered, in the aforesaid conventional container handling operation, onto upper locking assembly 88 and lock tightened in place at the four corners. The second storey unit 11 is then levelled at the four corners by the levelling assemblies 87, so that the second storey is level with the horizontal and about evenly spaced from the top of the ground floor unit. Alternatively, connectors 85 may first be locked to the lower corner fitting 66 of the upper unit 11, and the container unit/bottom connectors combination lowered into the orifices 64 of the ground floor unit 11 (see FIG. 7). This procedure is of course repeated until the desired number of storeys is provided. Other units 11*a*, 11*b*, 14, and the like are similarly vertically stacked.

Levelling of the container units is an important aspect of the present invention in that shipping container tolerances would otherwise provide cummulative unlevel flooring in a multi-storey building.

Figure 13:
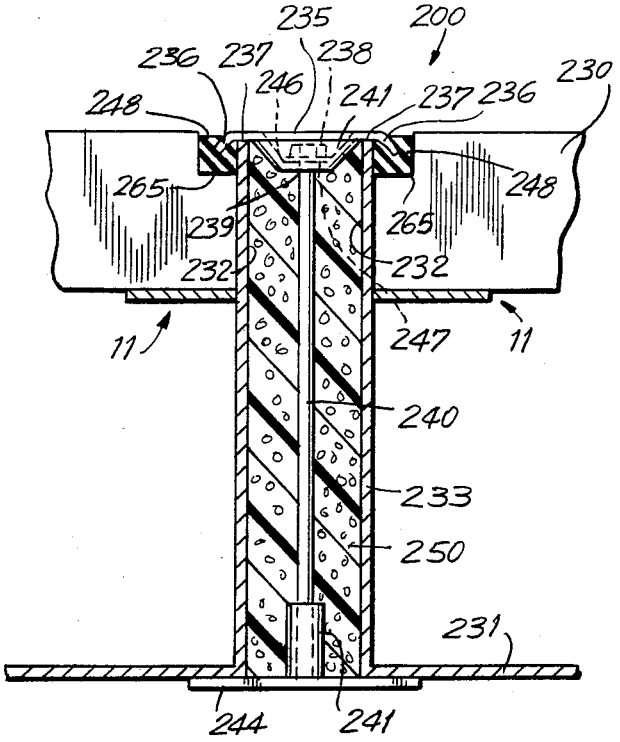
FIG. 13 is a partial sectional side elevational view of the horizontal connection of two container units.

It is important to note that in accordance with the afore-described multiple storey assembly, the bearing stress of the vertical structure is borne by or taken up through the fittings 66, 67, the vertical members 72 and the connectors 80, 85. When adjacent vertical multiple storey structures are provided, they need only be horizontally interconnected at their common walkway or corridor areas by "non-structural" flooring (FIG. 13). By the term "non-structural" as immediately aforesaid, it is meant that the horizontal flooring need only take the weight common to walk-way areas but not the bearing stress of the vertical structure. Thus, substantially the entire bearing stress of the structure is taken up by the vertical corner construction through the vertical connector.

Figure 4:
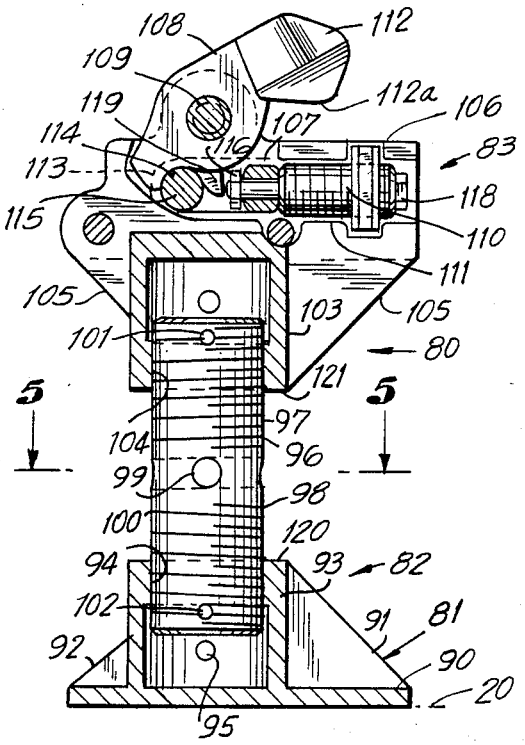
FIG. 4 is a front partial sectional elevational view of the connector for mounting the ground level container unit of FIG. 3.
Figure 5:
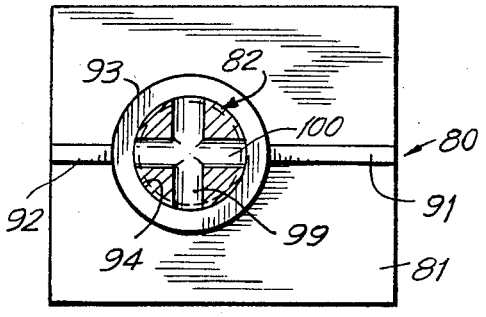
FIG. 5 is a sectional view taken along line 5—5 of FIG. 4.
Figure 6:
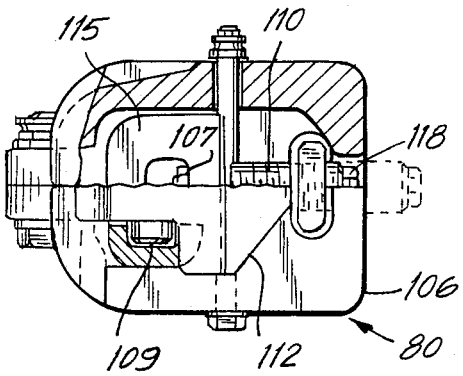
FIG. 6 is a top plan, partial fragmentary view of the connector of FIG. 4.

Referring now specifically to FIGS. 4–6, there are shown connectors 80 and 85 in detail. Connector 80 is formed with base pad 81 which is a casting having integral bottom plate 90, upright side support plates 91 and 92 and cylindrical housing 93. Housing 93 is formed with internal threads 94 and secondary through holes 95 (only one side shown). Levelling assembly 82 is formed of tubular member 96 being formed with oppositely disposed externally threaded ends 97 and 98, central crossing through holes 99 and 100, and upper and lower secondary through holes 101 and 102, respectively. Secondary through holes 95, 101, and 102 are for lock pieces (not shown) for protection in transport and to insure minimum thread engagement between the housings and the tubular levelling member. Locking assembly 83 is formed with cylindrical housing 103 having internal threads 104. End 121 of housing 103 is facingly disposed to end 120 of housing 93, and threads 104 engage threaded end 97, while threads 94 engage threaded end 98 of the levelling tubular member 96, so as to integrate assemblies 81–83 into connector 80. Housing 103 is integrally formed or cast with support plates 105 and 105*a*, to which is bolt mounted locking member housing 106. Member housing 106 in general terms is formed with a recess 107 into which connector element 108 is pivotally mounted by pivot 109, and locking element 110 is operably reciprocally mounted in threaded base 111. Element 108 is formed with a contoured head 112 having surface 112*a* for engaging the inside of an upper corner fitting. Connector element 108 is also formed with a contoured tail 113 having seat 114 and detente 119. Locking element 110 is also provided with a cross-member 115 bolted to the locking element 110 as at 116. Element 110 has a hex head 118 for wrench engagement for reciprocal movment. By this manner of construction, the inward driving of element 110 by the wrench action, in turn, drives cross-member 115 into seat 114 so as to pivot surface 112*a* of head 112 against the inside of the fitting and lock the connector 80 in place (locked position shown in FIG. 4). A full description of a similar container locking construction and assembly is provided in U.S. Pat. No. 3,972,439, granted Aug. 3, 1976 to DiMartino, which description is incorporated herein by reference thereto.

In the immediately aforesaid manner of construction, pad 81 is placed in the concrete base 20, and the container unit mounted and connected and locked by assembly 83. A bar (not shown) is then passed through one set of holes 99 or 100 and the bar rotated. In one rotation direction the length of tubular member 96 between faces 120 and 121 of housings 103 and 93, respectively, is lengthened, while with opposite rotation the length of tubular member 96 between faces 120 and 121 is shortened. By this action at the four bottom corners, the ground floor unit 11 may be levelled with the horizontal.

Figure 7:
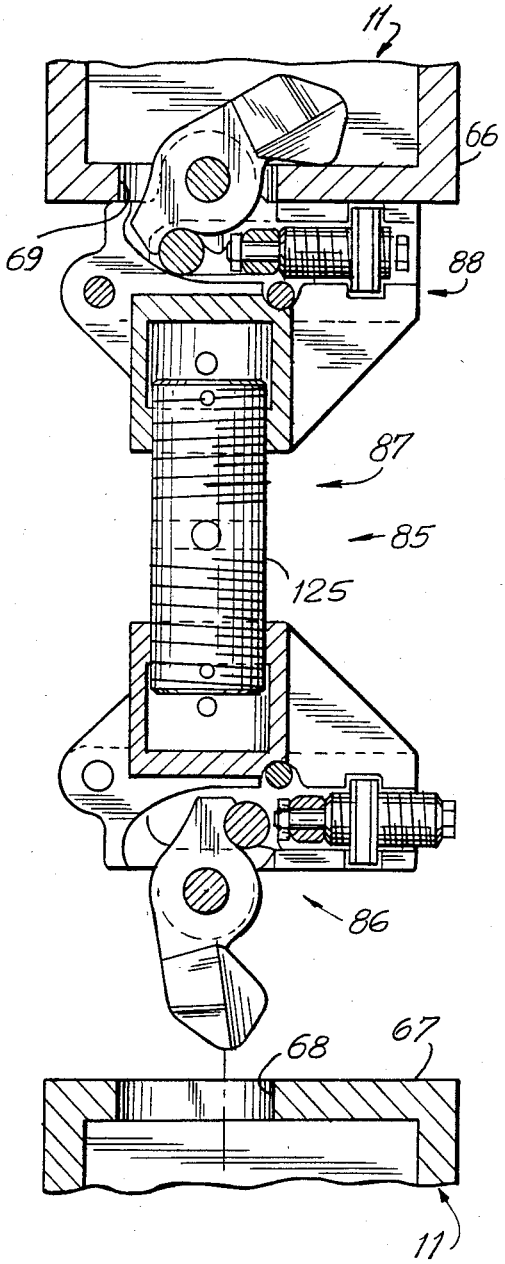
FIG. 7 is front partially sectioned elevational view of one embodiment of the connector for vertical mounting of container units.

Referring now specifically to FIG. 7, there is shown tandem connector 85 connecting upper and lower units 11. Connector assemblies 86 and 88 of connector 85 are similar in design, operation and function to the aforedescribed connector assembly 83, and levelling tubular member 96 is similar in design, operation and function to tubular member 125 of connector 85. In this manner of construction, connector assemblies 86 and 88 connect and lock upper and lower units 11, which are then levelled by the rotation of tubular member 125, at each of the four corners of the upper and lower units.

The construction of connector 80 has been described in relation to integrally combining a base support plate with a levelling tube and connector assembly. It is also within the contemplation of this invention that the base connector could also be a base plate integrally formed with a top I.S.O. fitting which base plate/fitting combination can then be connected to the ground floor container unit by the connector 85. That is the I.S.O. fittings of the base plate/fitting combination and the opposed bottom of the container unit would be connected with a connector 85. In this latter described alternative embodiment, only one type of self-levelling connector would be required.

Referring now to FIG. 8 there is shown unit 11*a* (typical) which houses three inmate cells 13 (typical) and a shower unit 13*a*. A passageway 130 is provided between end siding 76 and shower end wall 131. Passageway 130 is formed with a first or outer frameway 132 and an oppositely disposed second or inner frameway 133. Frameway 132 mates with one side of triangular frame unit 30, while the inner frameway 133 mates with the corridor 45*a* of unit 45. Horizontal walkway pieces 200 typical (FIG. 13) provide for connection flooring between the mating frame structures of the triangular frame with the frameway of the container units 11 and 45, as well as between the ends of the units.

Each cell 13 of container unit 11 is provided with an outer wall 135, with bars 143, siding 75 and two end walls 136 and 137, ceiling 138 and flooring 139. The front 140 of each cell is provided with a security sliding door 141, as well as a maintenance door 142. The interior of each cell 13 is provided with a bed 144, corner desk 145 and chair 146 integrally formed or bolted to the walls, a toilet commode 147, and an angularly disposed barrier wall 148. Wall 148 isolates cell portion 149 which contains the plumbing, heating and electrial service for each cell. Maintenance door 142 provides access to cell portion 149, which isolates the inmate in the cell from the maintenance operation. Thus with the inmate locked in the cell, a maintenance worker can nevertheless service the cell.

Referring to FIG. 9 there is shown a typical corridor/space extension container unit 14 which is formed of frame members 70, 73, and 74, I.S.O. corner fittings 66 and 67, flooring 150 and ceiling 151. Horizontal adjacent end-to-end units 14 form extended walkways or corridors 14*a*, while horizontal adjacent side-to-side units 14 form useful extended space areas, as previously described in connection with FIG. 2.

FIG. 10 shows the detail of the frame and corner fitting construction. Specifically, there is upper I-beam cross-member 156 which is welded and mounted into the channel 157 of frame 73, and lower I-beam cross-member 158 which is welded and fitted to channel 159 of frame 70. It is noted that I-beam 158 may be provided with through holes 160 and 161 for receiving utilities conduits (not shown). Outer frame holes 160*a* and 161*a* are also provided for receiving the utilities conduits (see FIG. 8). The overall welded frame construction is readily achieved in a manner well known in the shipping container construction field.

Figure 11:
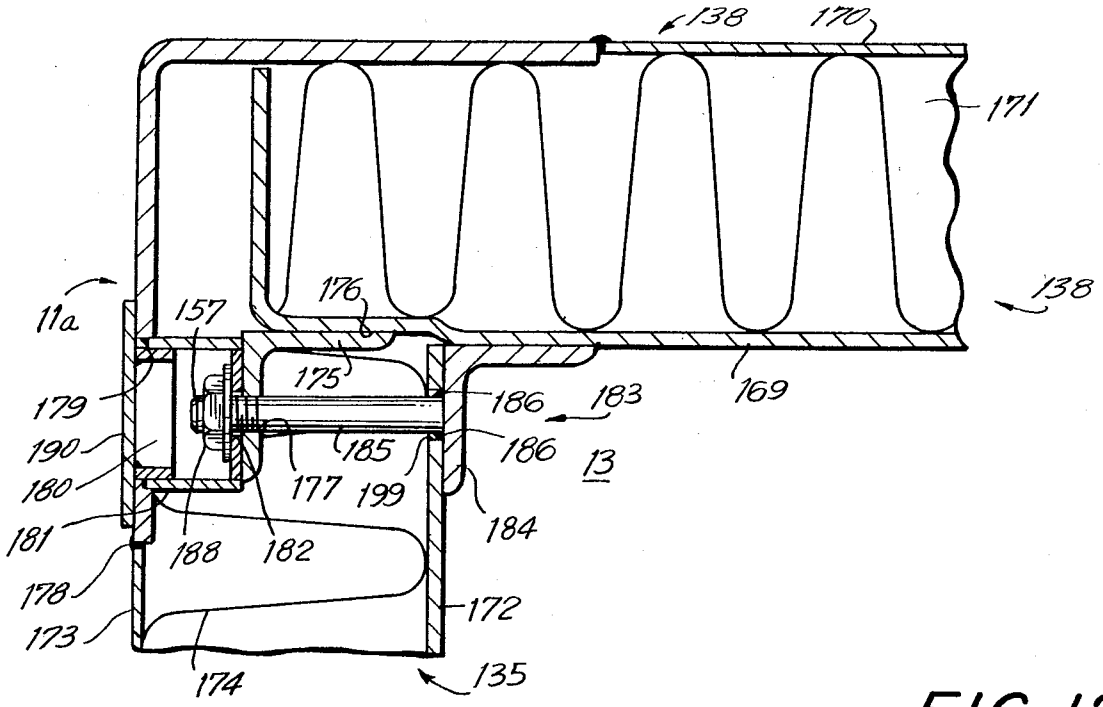
FIG. 11 is a detail view of the corner construction of the container unit with the interior walls in place.

FIG. 11 shows the preferred interior wall and ceiling construction. Ceiling 138 is formed of inner metal frame member 169 and outer metal frame member 170 with insulation 171 held therebetween. Wall 135 is formed with inner metal frame member 172 and outer metal frame member 173 with insulation 174 held therebetween. An angle 175 is welded to the bottom chair 176 of member 169, which angle is formed with through hole 177. Edge 178 of member 173 and edge 179 of member 170 form an opening 180 into which cup 181 fits, and is welded at 179 and 178. Cup 181 is formed with through hole 182 which is coaxial with hole 177. A lock assembly 183 formed of angle 184 and threaded bolt 185 which is welded at 186 to angle 184, which bolt 185 is passed through holes 199, 177 and 182 so that threaded end 157 extends outwardly from cup 181. A hex nut 188 and washer 189 complete the assembly so as to mount and lock wall 135 to ceiling 138. A flange cap or cover 190 is sealed in place over cup 181 to prevent access to lock bolt 185 and to prevent water from entering the wall 135.

In the aforesaid manner of construction the walls and ceiling of the cells are interconnected from the outside so that the inmates do not have access to the wall-ceiling connecting elements.

Figure 12A:
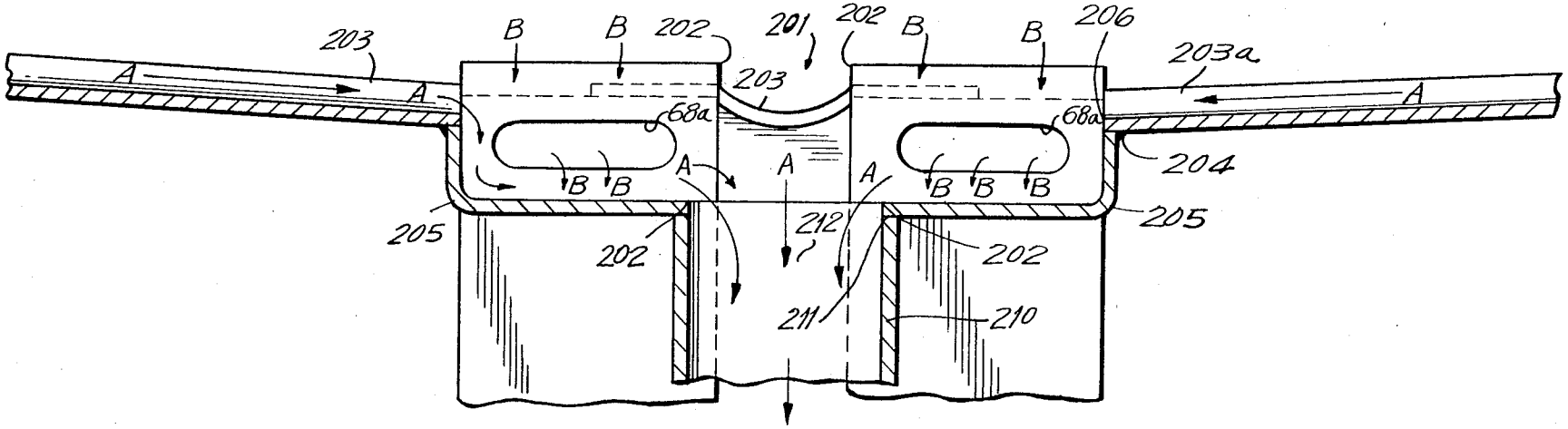
FIG. 12A is a sectional view taken along line 12A—12A of FIG. 12.
Figure 12:
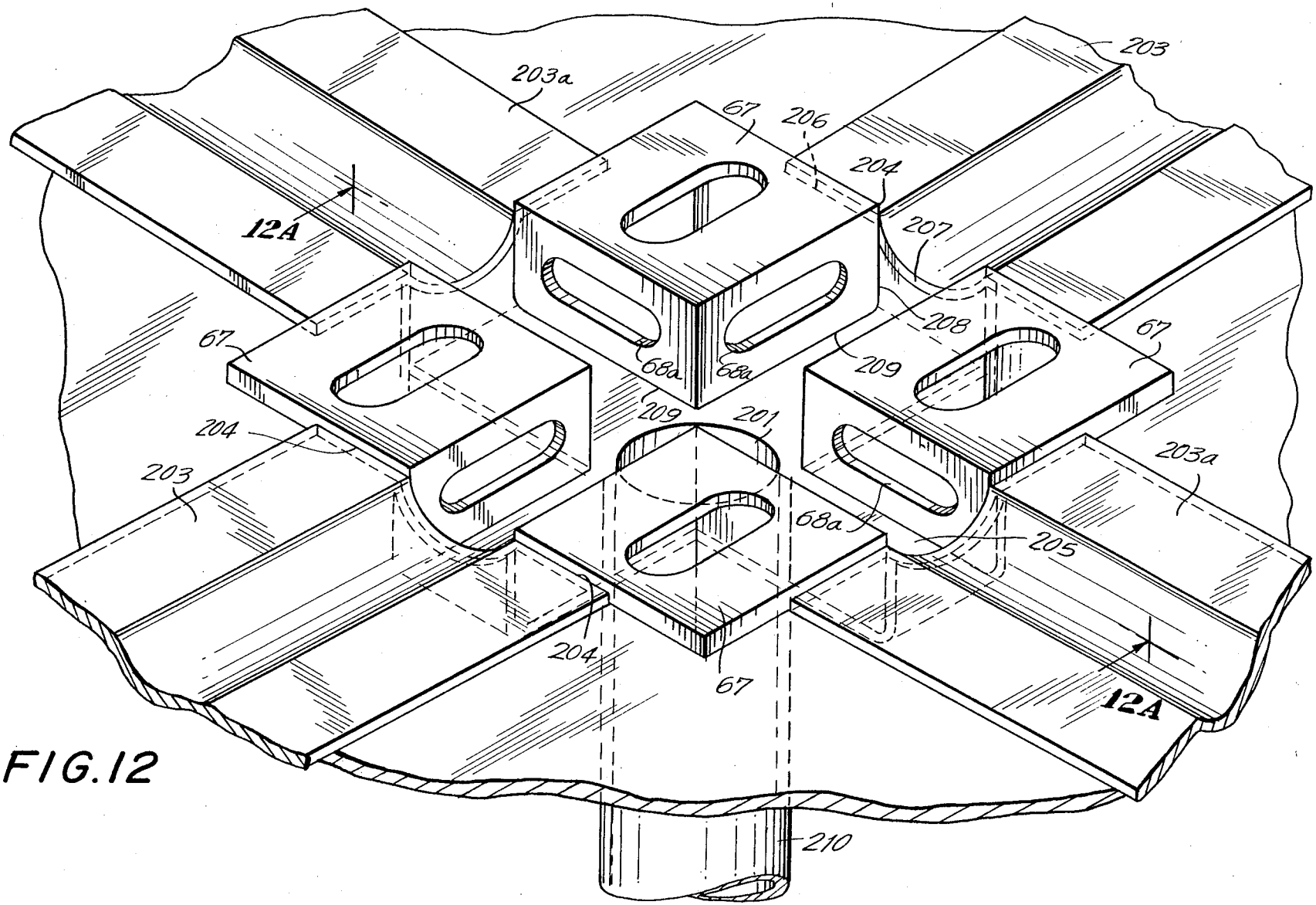
FIG. 12 is partial fragmentary respective view of four container units meeting at a common corner and drainage gutters forming a vertical drainage conduit.

Referring now specifically to FIGS. 12 and 12A, there is shown four container units meeting at common corner 201, with the top corners 202 of each unit being in parallel side-by-side and end-to-end relationship. Top I.S.O. corner fittings 67 are, of course, common to each container. Metal drainage gutters 203, 203*a* are mounted with and between corners 202 and extend the full length of the respective sides or ends of the containers. Gutters 203 and 203*a* are formed so as to slope downwardly from the center to the gutter ends, i.e., to the common corner 201. The end 206 of each gutter abuts the fittings 67 as shown at 204 (typical) and is sealed thereat by suitable water-sealant means. A recessed cross-member well 205 fits between and within gutters 203, 203*a* and fittings 67 and is sealably mounted therein as at 207, 208 and 209. A vertical drainage conduit 210 is welded or bonded to the periphery 211 of hole 212 formed in cross-member well 205.

The immediately aforesaid construction and assembly provides a drainage system from the roof of the structure. Water accumulates in the gutters and passes down the oppositely disposed slopes of the gutters, into cross-member well 205 and then, in turn, to the central vertical conduit 210, as shown by arrows A in FIG. 12A. Additionally, water may enter orifice 68 and pass through fitting 67 and, in turn, pass from side orifice 68*a* into cross-member well 205, as shown by arrows B, and finally into the vertical conduit 210.

Referring now specifically to FIG. 13, there is shown horizontal connection assembly 200. The floor panels 230 and ceilings 231 of adjacent units 11 are shown mounted at their ends 232. A metal frame box 233 is disposed between the ends and a metal floor plate 235 is formed with flanges 236 for engaging the edges 237 of panel 230. Plate 235 is formed with recess 238 having central hole 239 therein. Rod 240 is threaded at its ends 241, with the lower end engaging internal threads 242 of tubular member 243. Member 243 is welded to plate or fairing 244 so as to engage the underside of frame member 245. A nut 246 and washer 247 engage the upper threads of rod 240 so as to tighten floor plate 235 and plate 249 in place. With plate 235 tightened in place, rubber sealant material 265 fills the crevices 248 between to plate 244 and the flooring. Foam in place insulation 250 fills the box 233 to provide a sealed insulated construction.

Figure 14:
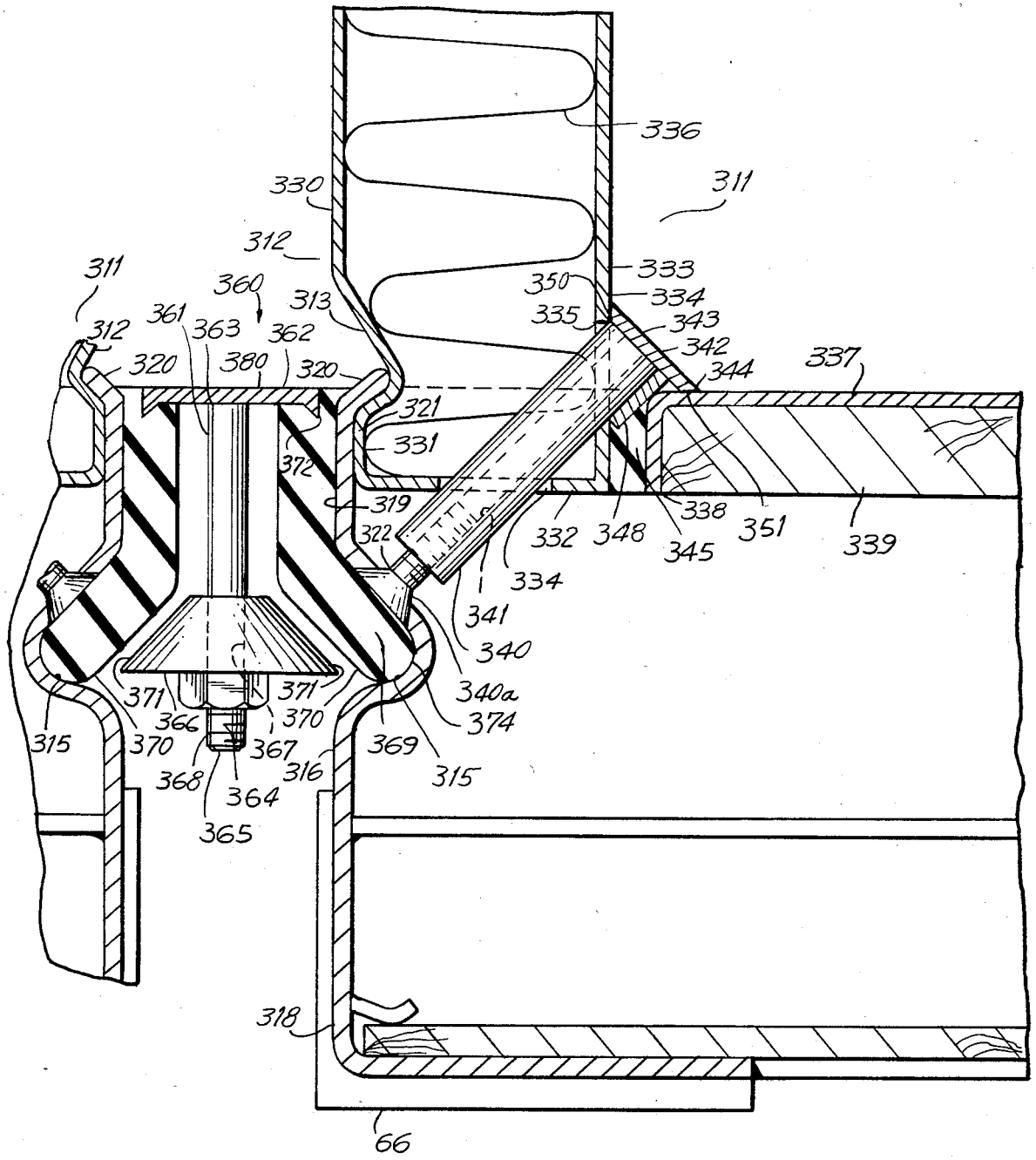
FIG. 14 is a sectional elevational view of an alternate embodiment for horizontal connection and wall-to-flooring connections of the container units.

Referring now specifically to FIG. 14 there is shown an alternate embodiment related to the specific aspects of horizontal connection of the containers and the wall-to-flooring or wall-to-ceiling connection as well. Container units 311 are shown with end or end walls 312 in opposed facing relationship. Container units 311 are similar to the aforedescribed units 11 except as otherwise described hereinafter. One significant structual modification of unit 311 is the presence of a recess 313 in the end wall 314, and in the side wall (not shown) as well. A second recess 315 is formed in the end wall portion 316 of flooring 317, and in the side wall portion (not shown) as well. A plurality of countersunk spaced holes 322 (typical) are formed in the wall of recess 315.

More specifically, flooring section 317 is formed with the metal end edge portion 318 to which is mounted standard I.S.O. corner fitting 66 at the corner edge thereof in a manner similar to that previously described. Portion 318 extends vertically upwardly until recess 315 is provided and then a second vertical section 319 is provided which terminates in an inwardly angled end piece 320. End piece 320 fits within first recess 313, with floor section 321 abutting wall section 319.

End wall 312 is formed of outer wall portion 330, recess 313, lower wall portion 331, bottom wall portion 332, and inner wall portion 333. A series of holes 334 (typical) are formed in bottom wall portion 332 and are spaced along the length of the bottom wall. A second series of holes 335 (typical) are formed in inner wall portion 333, and are spaced along the length of the inner wall. Insulation 336 is implaced between outer walls 330, 331 and inner wall 333.

Flooring 317 is formed of metal floor 337 which has end wall portion 338, with metal walls 337, 338 covering wood flooring 339. End floor portion 338 is adjacent to and faces inner wall portion 333. It is of course understood that this wall and floor instruction is common to all the walls of the cell.

A tubular member 340 is formed with internal threaded bore 341 and end cap 342. Cap 342 is formed of end plate 343 with chamfered ends 344 and part cylindical side bearing plate 345 for purposes hereinafter appearing. Bolt 346 is threaded into bore 341, with member 340 angularly disposed within holes 334 and 335, with chamfered bolt head 340*a* seating in countersunk hole 322. In this manner of construction, by screwing bolt 346 into bore 341, end plate 346, or more accurately chamfered ends 344 pressingly engage metal inner wall 333 and metal floor 337 so as to provide a tight flush finish at 350 and 351 between the wall 333, the plate 346 and the floor 337. Rubber sealant 348 is pressed by caulking gun or other means between wall 333, plate 345 and wall 338, to complete a full watertight seal of the inside of the cell. Drainage (not shown) is provided in the flooring 317. In this manner of construction, the cell can be cleaned by simply hosing the inside of the cell with the water passing to drainage in the flooring. Furthermore and quite significantly, the bolt-tightened flush finish at 350 and 351 prevents an inmate from trying to wedge an opening between the wall and flooring for vandalism or possible attempted escape.

Horizontal connection assembly 360 is formed of vertically disposed bolt 361 with steel end plate 362 welded thereto at one end 363. Bolt 361 is formed with threads 364 at the other end 365. A tapered cylindical collar 366 is formed with internal threads 367 for engaging threads 364. A nut 368 completes the assembly. Cylindical rubber collar 369 is fitted around bolt 361 so that tapered rubber surface 370 engages tapered metal surface 371 of the collar. Sharpened corner cylindical edge 372 of plate 362 bites into rubber collar 369 to hold the rubber collar to the metal assembly. In tightening down on bolt 361, the bulbous rubber portion 374 pressingly seats with the recess 315, so as to seal the space between the ends of the container, as well as to seal bolt head 342 in place. Rubber or plastic flowable sealant material (not shown) may be provided between collar portion 374 and the wall forming recess 315.

It is important to note that this bolt 361 tightening seal and horizontal connection is made possible because in tightening the bolt a wedge force is applied through the rubber collar 369, with the reaction force being taken up by the locked-in-place I.S.O. fittings 66 and 67.

Furthermore, while the present construction of this latter said embodiment is shown for container end-to-end and wall-to-floor construction, it is also understood that side-to-side as well as wall-to-ceiling construction is also contemplated. In the wall-to-floor construction, it is to be noted that top flat surface 380 of plate 362 may serve as the walkway of adjacent side-to-side to units, so that a person walking from a cell to a hallway may step on this plate surface.

It is important to bear in mind that while the aforediscussed preferred embodiment is shown as a correction facility, the present invention contemplates a broad range of structures, including by way of example, office buildings, hospitals, schools, low cost housing particularly for temporary site construction and other projects, and the like.

Thus, the present invention has been described with respect to certain preferred embodiments thereof. However, it will be understood that various changes and modifications may be made without departing from the scope of the invention.

What is claimed is:

1. A building system comprising:

a plurality of similarly sized shipping container units, wherein each unit comprises functional components for a specific living environment function, and each unit being formed with a fitting at each respective corner of each unit, and mounting connectors being formed so as to be disposed between upper and lower container units and having means to vertically interconnect the fittings of said upper and lower container units further comprising a second plurality of units mounted adjacent said first plurality and means to horizontally interconnect said pluralities, and wherein substantially the entire building load bearing stress is taken in the vertical direction through the fittings and mounting connectors and wherein at least one unit is a hallway unit, said hallway unit being formed so as to provide common access between other horizontal interconnected units, wherein the horizontal connection means comprises a plate being formed at oppositely disposed ends with means for engaging adjacent units so as to provide a walkway between the units, and means to supportively mount said plate between and with said adjacent units, whereby upon interconnection of said fittings and walkways a multiple storey building is formed with common access provided by the hallway unit between specific living environmental function units.

2. The building system of claim 1, wherein said units consist of at least two selected from a berthing unit, comprising a plurality of berths, a hallway unit, and a recreational unit, comprising recreational furnishings, whereby the hallway unit provides common access to other units upon horizontal interconnection of the units.

3. The building system of claim 1, further comprising a first plurality of units comprising inmate cells and a second plurality of units consisting essentially of hallway units wherein the hallway units are disposed between the inmate cell units so as to form a prison structural section.

4. The building system of claim 1, said connectors conprising upwardly and downwardly disposed locking elements, and means to selectively pivot each of said elements from unlocked to locked positions and wherein the locking elements frictionally engage the respective fittings.

5. The building system of claim 4, each of said connectors further comprising means to level the connectors and, in turn, the containers interconnected therewith.

6. The building system of claim 5, wherein said fittings are standard I.S.O. shipping container fittings.

7. The building system of claim 3, further comprising drainage conduit means disposed at the respective top corners of side-by-side units, so that wherein four container units in the same horizontal plane are mounted at a common corner, said conduit means meet at the common corner.

8. The building system of claim 7, said conduit means being formed with a vertical disposed conduit centrally disposed to said drainage conduit means.

9. The building system of claim 1, further conprising a base support pad, and second mounting connectors for mounting the lower unit onto the pad, said second mounting connectors comprising means for supporting the lower unit on the pad and means for engaging bottom corner fittings of the lower container unit, and wherein each of said second mounting connectors comprises means for levelling said lower unit.

10. A prison comprising:

a first plurality of container units, each of said first plurality units comprising inmate cells, a second plurality of container units each of said second plurality units consisting essentially of a hallway unit; connectors to vertically connect said first plurality of units, and to vertically connect said second plurality of units adjacent said first plurality, and means to horizontally connect said first and second pluralities of units, wherein the horizontal connection means comprises a plate being formed at oppositely disposed ends with means for engaging the flooring of adjacent units so as to provide a walkway between the units, and means to interconnect said plate with a second plate formed at and engaging the bottom of said adjacent units, further comprising two first pluralities being connected to a said second plurality unit disposed between the first pluralities so as to form a substructure having a common hallway for the inmate cells of the two first pluralities to form a multistory prison.

11. The prison of claim 10, further comprising at least two said sub-structures, and a central guard control booth unit for each storey disposed between the sub-structures at each storey to form a secured section, whereby a guard within the central booth of the secured section can view the hallways of the sub-structures from the booth unit.

12. The prison of claim 10, further comprising at least two said sub-structures being disposed at 90°, and a third plurality of container units comprising inmate environment functional elements, and other said connectors vertically connecting said third plurality units, and said third plurality of units being disposed at 45° with and between said sub-structures, and means to horizontally interconnect said third plurality of units to opposing units of said sub-structures.

13. The prison of claim 12, further comprising a guard control booth unit for each storey being disposed between said sub-structures adjacent said third plurality units, and means to horizontally interconnect each guard control booth unit to the adjacent sub-structures and the third plurality of units, whereby a single guard can view the hallways of the sub-structures and into said third plurality units from the control booth.

14. The prison of claim 13, wherein the inmate environmental functional elements comprise an inmate recreation room.

15. The prison of claim 11, further comprising a second secured section, and pluralities of other container units being vertically and horizontally interconnected comprising environmental functions forming at least one section being less secured than said secured section and being disposed between the first and second secured sections, and means to horizontally interconnect said less secured section to said secured sections, whereby the said less secured section is commonly accessible to both said secured sections.

16. The prison of claim 15, said less secured section comprising egress means from the prison, and said secured sections being without egress means.

17. A connector for a shipping container unit comprising;

a housing being formed at one end with a recess; a connector element, and means for pivotally mounting said connector element so that the element is pivotally disposed within the recess; and means for selectively pivoting said element so that with the connector disposed adjacent a container fitting having hole therein the element is disposed within the hole, and said means to selectively pivot said element is actuated to frictionally engage one surface of the inside of the fitting to hold the fitting against the connector, and said connector futher comprising means for levelling the container, said levelling means being operably disposed at the end of the housing remotely disposed from the connector element, said levelling means being vertically disposed and having a vertical axis, and said connector element being pivotally disposed about an axis tranverse to said vertical axis, and said means for pivoting said element and said means for levelling said container being operable at one same side of said connector, whereby the connectors connect the container fittings at the bottom corners of the container and the connected container is levelled by said levelling means.

18. The connector of claim 17, said connector element comprising a head and tail, and wherein the head is formed with a bearing surface to frictionally engage one surface of the inside of the fitting.

19. The connector of claim 18, said tail being formed with a seat, and said pivoting means being provided with a cross member, whereby in actuating said pivoting means said cross member is pressingly engaged within said seat and said head frictionally engages said fitting as aforesaid.

20. The connector of claim 17, said levelling means comprising a vertically disposed tubular member being formed with screw threads at opposite upper and lower ends thereof, and a base member being formed with a receiving member formed with screw threads for interengaging the lower end screw threads of the tubular member, and said housing being formed with a second receiving member formed with screw threads for interengaging the upper end of the tubular member, said tubular member being formed with means for rotating the tubular member relative to said first and second receiving members, whereby in rotating said tubular member the distance between the container housing and base member is changed so as to level the container at its four bottom corners.

21. The connector of claim 20, said base member being formed with a bottom plate for mounting on a construction site pad.

22. The connector of claim 20, said first and second receiving members being fixedly disposed within the respective housing and base.

23. A connector for the vertical mounting and levelling of a container comprising;

first and second housings being formed at oppositely disposed respective ends with a respective recess; first and second connector elements and means to pivotally mount the connector elements in the respective recess, and respective means for selectively pivoting each connector element; and container levelling means being disposed between the housings and connected to the housings so that one element is upwardly disposed and one element is downwardly disposed, said levelling means being vertically disposed and having a vertical axis, and said connector elements being pivotally disposed about axes tranverse to said vertical axis, and said means for pivoting said element and said means for levelling said container being operable at the same one side of said connector, whereby the upwardly disposed element engages the bottom fitting of an upper container and the lower element engages a top fitting of one selected from a construction base pad and a container so that the upper container is mounted and levelled.

24. The connector of claim 23, said levelling means comprising a tubular member being formed with screw threads at opposite ends, and oppositely disposed receiving members being formed in said housings for engaging the opposite ends of the tubular member, said tubular member being formed so as to rotate relative to said receiving members and housings so as to change the distance between the upper container and the base pad or lower container, thereby levelling the upper container at its four bottom corners.

25. The connector of claim 24, each said receiving member being fixedly connected with the respective housing.

26. The connector of claim 17, further comprising in combination, a module container comprising living enviornmental elements for a specific living environment function, whereby a plurality of the containers are connected and levelled with a plurality of said connectors.

27. The connector of claim 26, wherein each of the living environmental elements are selected from one for a berthing unit, a hallway unit, and a recreational unit.

28. An inmate prison cell modular building unit comprising:

a shipping container;

an inmate cell being formed in the container; said inmate cell being provided with a wall and an adjacent floor and ceiling, said wall being mounted interiorly of the side of said shipping container, and means to connect said wall to one side of the shipping container to form a flush fit, wherein said wall connection means including a bolt having a flange at the end thereof, said flange including chamfered ends so as to pressingly engage the inside wall and adjacent floor or ceiling to form a flush fit and said connection means being operably accessible from outside the said side of the shipping container, but being inaccessible from the inside of said inmate cell, and wherein said wall conection means being affixedly connected to the said wall, whereby with actuation of said wall connection means from outside, the flange pressingly engages the wall and adjacent floor or ceiling so that a tamperproof inmate wall connection is formed.

29. In combination, two adjacent shipping containers having opposing sides, each said container being formed with an inside wall and an adjacent floor;

means to hold said containers from horizontal movement, said container sides each being formed with a recess, and said means to hold being formed so as to fit within said recess, and means to resiliently press against the opposing sides to form a resilient connection of the containers;

means for flush fitting of the inside wall and the adjacent floor of each container, comprising wherein each of the container sides being formed with a hole extending to the inside wall and adjacent floor, bolt means being formed so as to be operatively received in said hole, said bolt means comprising an end plate having chamfered ends so as to pressingly engage the inside wall and the adjacent floor in tightening the bolt means;

whereby in tightening the bolt means a flush inside wall and floor fit is formed and in actuating the resilient pressing means the adjacent containers are resiliently horizontally mounted.

30. The combination of claim 29, said bolt means comprising a bolt, and a tubular housing into which said bolt means threadably fits said plate being fixedly attached to said housing.

31. The combination of claim 29, said plate being metal and said inside wall and floor being metal wherein the flush fit prevents one from trying to wedge an opening between the wall and floor.

* * * * *